US005881605A

United States Patent [19]

Doolittle et al.

[11] Patent Number: 5,881,605

[45] Date of Patent: Mar. 16, 1999

[54] PARKING BRAKE ACTUATOR WITH PLASTIC OPERATING LEVER

[75] Inventors: Miles George Doolittle, Royal Oak, Mich.; Anthony R. Gurney, Toledo, Ohio; Sean O'Rourke, Waterford, Mich.

[73] Assignee: Dura Automotive Systems, Rochester Hills, Mich.

[21] Appl. No.: 785,385

[22] Filed: Jan. 21, 1997

[51] Int. Cl.[6] ..... G05G 1/14

[52] U.S. Cl. ..... 74/512; 74/560

[58] Field of Search ..... 74/560, 512, 540, 74/542

[56] References Cited

U.S. PATENT DOCUMENTS

| | | | |
|---|---|---|---|
| 3,236,120 | 2/1966 | Fender | 74/512 X |
| 3,236,121 | 2/1966 | Gdowik et al. | 74/512 X |
| 5,211,072 | 5/1993 | Barlas et al. | 74/512 |
| 5,309,786 | 5/1994 | Pare et al. | 74/512 |
| 5,533,421 | 7/1996 | Damerow et al. | 74/560 X |

FOREIGN PATENT DOCUMENTS

| | | | |
|---|---|---|---|
| 34 27 097 | 1/1986 | Germany | 74/560 |
| 42 26 352 | 2/1993 | Germany | 74/512 |
| 42 11 640 | 10/1993 | Germany | 74/560 |

*Primary Examiner*—Charles A. Marmor
*Assistant Examiner*—Mary Ann Battista
*Attorney, Agent, or Firm*—David A. Greenlee

[57] ABSTRACT

A parking brake actuator for applying and releasing a cable-operated vehicle parking brake includes an operating lever pivotally mounted on a mounting bracket for movement between brake-released and a plurality of brake-applied positions. The operating lever is a unitary molding made of a glass-filled thermoplastic and has an integral footpad. A metal insert which mounts the cable end, includes a sector gear, that is secured to the operating lever by rivets and engages a pinion which is pivoted to the mounting bracket. The operating lever has a raised drive lug that is received in a mating drive aperture in the insert and transfers brake-apply forces from the operating lever to the sector. A one-way clutch normally permits the pinion to rotate freely when the operating lever is operated to apply the parking brake, but prevents reverse rotation of the pinion to maintain the parking brake applied. A clutch release is operable to disable the one-way clutch and permit reverse rotation of the pinion to release the parking brake and allow the operating lever to return to released position. The plastic operating lever only experiences the high brake-apply forces during brake-apply motion. When the parking brake is set, the operating lever is isolated from the cable load path.

8 Claims, 4 Drawing Sheets

FIG 2
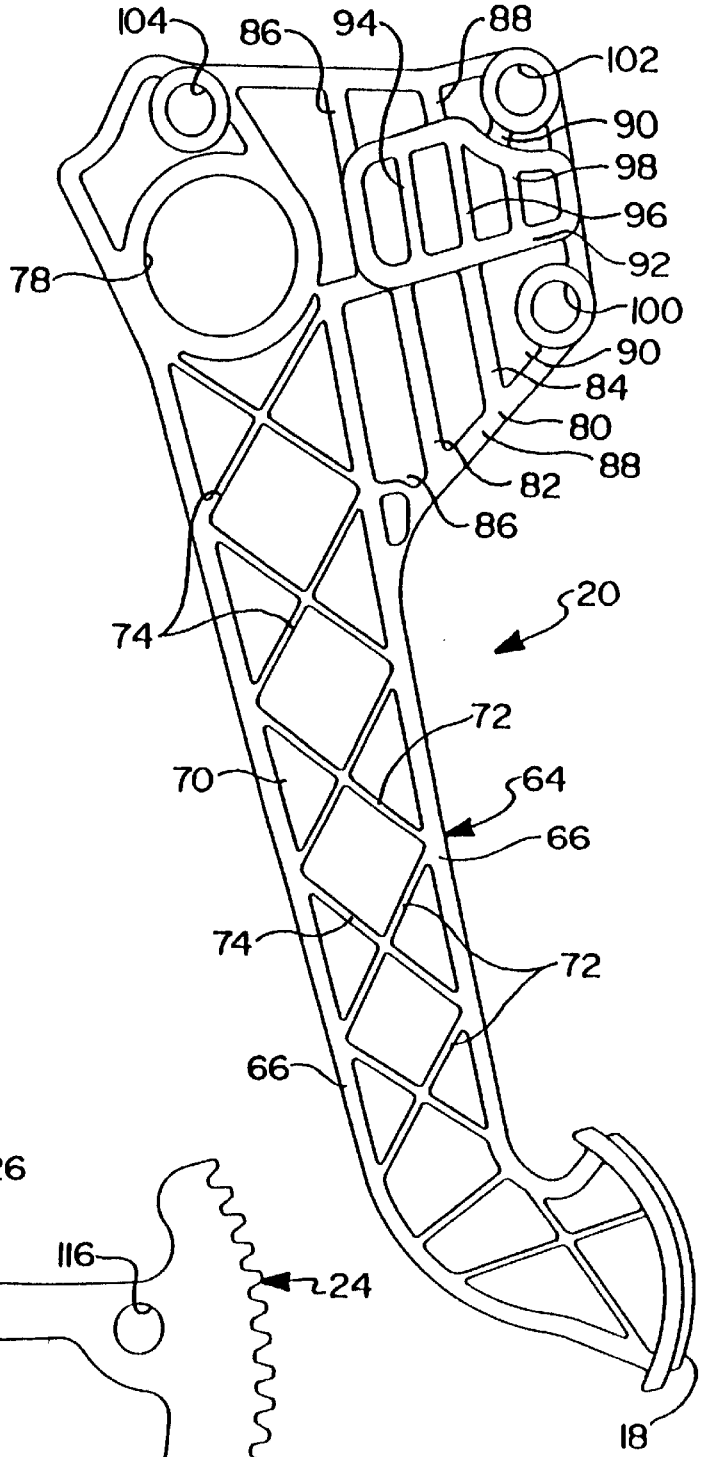
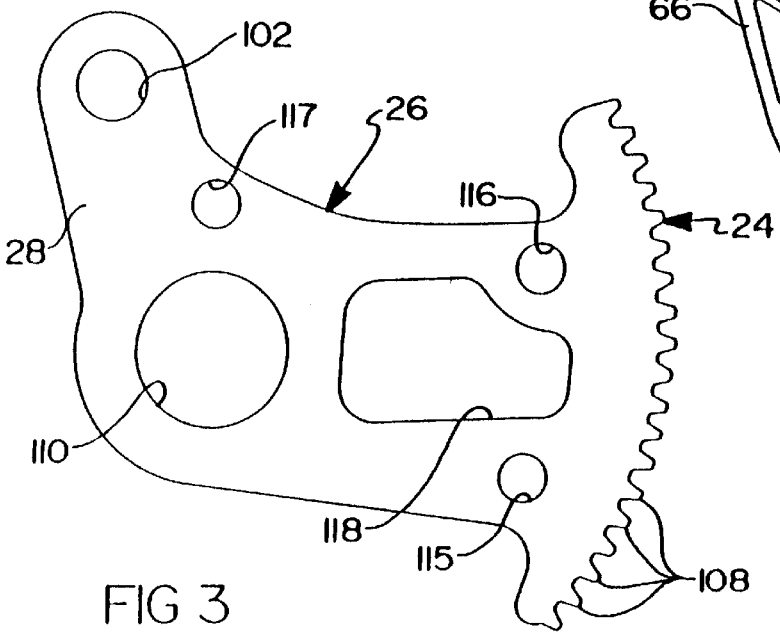
FIG 3

FIG 5
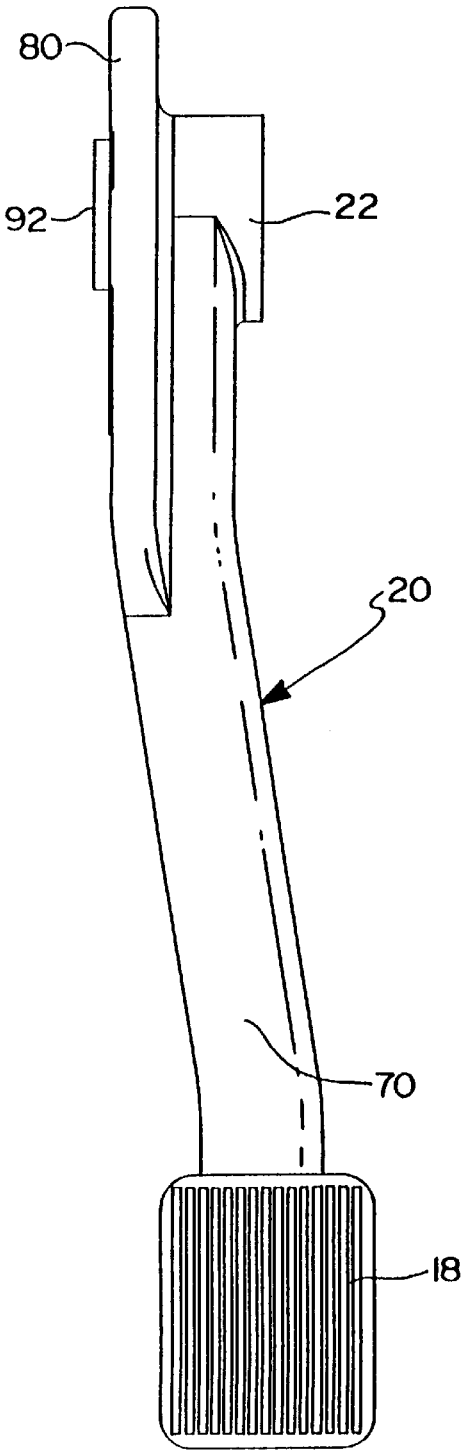
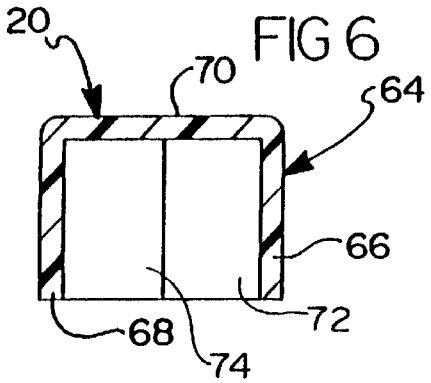
FIG 6
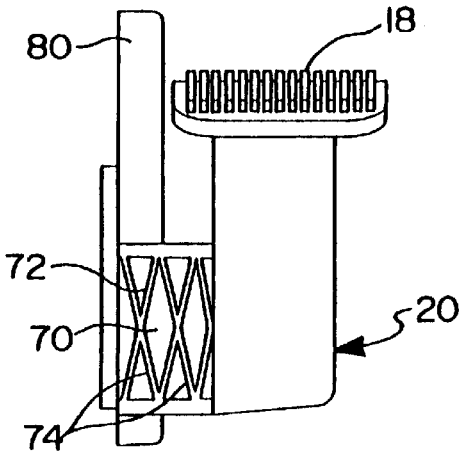
FIG 7

PARKING BRAKE ACTUATOR WITH PLASTIC OPERATING LEVER

BACKGROUND OF THE INVENTION

This invention relates generally to vehicle parking brake actuators and, more particularly, to an improved operating lever for operating the parking brake actuator.

Several types of hand- and foot-operated parking brake actuators are in use. One popular foot-operated parking brake actuator uses an operating lever which mounts a sector gear that is in constant mesh with a pinion. A torsion spring has one fixed and one free end and grips the pinion hub as a one-way clutch. This allows the pinion to rotate as the operating lever is moved to a brake-apply position, but prevents reverse rotation to latch the lever in the brake-apply position.

The torsion spring free end is engaged by a brake release member to spread the spring and release the pinion hub to unlatch the pinion, which releases the lever for movement to brake-released position. One such parking brake actuator is disclosed in U.S. Pat. No. 3,236,120 to Fender in which the torsion spring is releasable by a vacuum actuator. In many current vehicles, this type of parking brake actuator has been modified to replace the vacuum actuator with an electric actuator, as shown in U.S. Pat. No. 5,029,681 to Swiatek.

Contemporary parking brake actuators utilize a stamped or cast steel operating lever. Hand-operated levers are fitted with a plastic or leather handgrip. In foot-operated parking brake actuators, the steel lever is fitted with a rubber footpad. Because of their construction, these operating levers are heavy and relatively expensive. Also, the rubber footpads wear rapidly, causing increased warranty expense for the vehicle manufacturer.

There is a need for an improved operating lever for a parking brake actuator that is lighter and cheaper than contemporary operating levers and which is constructed to reduce warranty expenses.

SUMMARY OF THE INVENTION

It is therefore an object of this invention to provide an improved operating lever for a parking brake actuator that is lighter and cheaper than contemporary operating levers and which is constructed to reduce warranty expenses.

There have been attempts to utilize plastic foot pedals for vehicle clutches. Clutch pedals are subject to momentary low-level stresses which have a low predetermined maximum stress requirement. Heretofore, no plastic brake or parking brake pedals have been attempted, because none were thought to be capable of the high maximum stress levels experienced by brake application. The stresses experienced by brake pedals is limited only by the strength of the vehicle driver, as is the stress experienced by hand levers.

Parking brake operating levers experience very high stresses upon application and latching in applied position. In most conventional parking brake actuators, these high stresses are sustained throughout parking brake application, after until relieved by release of the parking brake. In other parking brake actuators, such as of the multiple pump variety, the high stress level is relieved once the parking brake actuator is latched in brake-applied position.

In one aspect, this invention features a parking brake actuator for applying and releasing a cable-operated vehicle parking brake which comprises an operating lever pivotally mounted on a mounting bracket for movement between brake-released and a plurality of brake-applied positions.

Attachment means attach the cable end to the operating lever. A sector gear mounted on the operating lever is engageable with and rotates a pinion mounted on the bracket. A one-way clutch normally permits the pinion to rotate freely when the operating lever is being operated to apply the parking brake, but prevents reverse rotation to maintain the parking brake applied. A clutch release is operable to permit reverse rotation of the pinion to release the parking brake and allow the operating lever to return to released position. The operating lever is a unitary molding made of fiber-filled thermoplastic, such as a polyester.

Preferably, the operating lever is made of 30%–45% glass fiber-filled nylon (one preferred form is 40% glass filled Nylon 3), molded in the form of a hollowed, three-sided shell having an internal egg-crate reinforcing structure and an integral footpad.

In another aspect, this invention features a metal insert can be mounted on the operating lever as the cable attachment for high sustained stress loads. This could include, or at least mount, the sector which, in any case should continue to be metal, since it meshes with a metal pinion. The operating lever has a raised drive lug and the insert has a mating drive aperture.

The metal insert preferably includes a central aperture which is fitted over a mating raised hub on the operating lever to transfer the cable forces to the operating lever during brake apply movement of the operating lever and to isolate the operating lever from cable forces in any brake-applied position. The insert is attached to the plastic operating lever by rivets, which are received loosely in holes in the operating lever. Preferably, the rivets transfer no cable forces.

The operating lever can be formed with an integral footpad, having a predetermined non-skid design that can include logos or other decorative designs. The operating lever can be formed of any color plastic to harmonize with any vehicle interior color.

These and further objects and features of this invention will become more readily apparent upon reference to the following detailed description of a preferred embodiment, as illustrated in the accompanying drawings, in which:

BRIEF DESCRIPTION OF THE DRAWINGS

FIG. 2 is an enlarged side view of the operating lever of FIG. 1;

FIG. 3 is an enlarged side view of the metal insert used with the operating lever of FIG. 2;

FIG. 5 is a top view of the operating lever;

FIG. 6 is a sectional view taken along line 6—6 of FIG. 4; and

FIG. 7 is an end view of the operating lever.

DETAILED DESCRIPTION OF PREFERRED EMBODIMENTS

Figure 1:
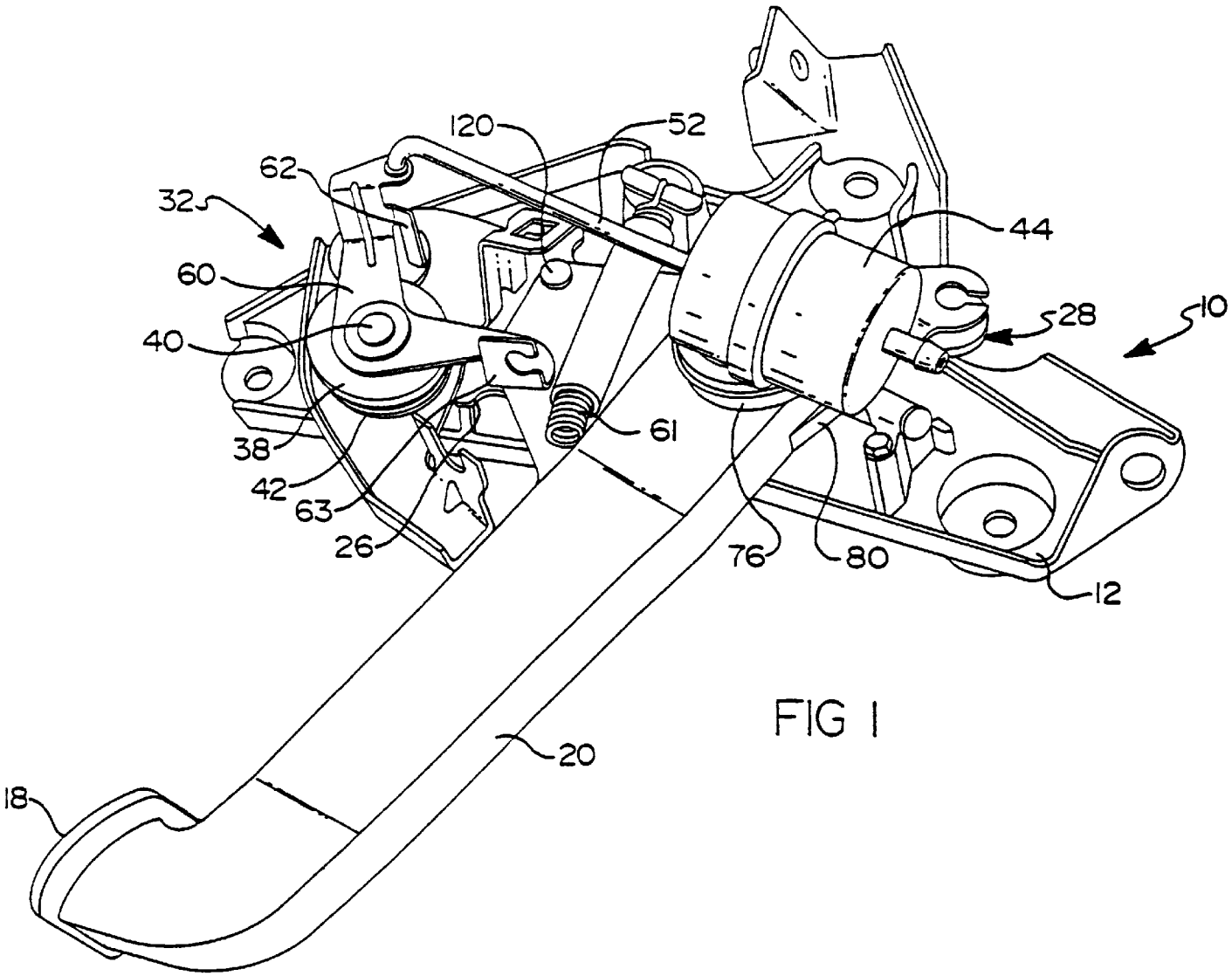
FIG. 1 is a perspective view of one embodiment of parking brake actuator incorporating a operating lever according to this invention.

In FIG. 1, a parking brake actuator 10 includes a mounting bracket 12 which is mountable beneath the instrument panel of an automotive vehicle, as shown in U.S. Pat. No. 5,029,681 to Swiatek, the disclosure of which is incorporated herein by reference. Parking brake actuator 10 applies and releases a vehicle parking brake (not illustrated) by pulling and releasing an operating cable (not illustrated), as shown in FIG. 1 of the aforementioned Swiatek patent.

Figure 4:
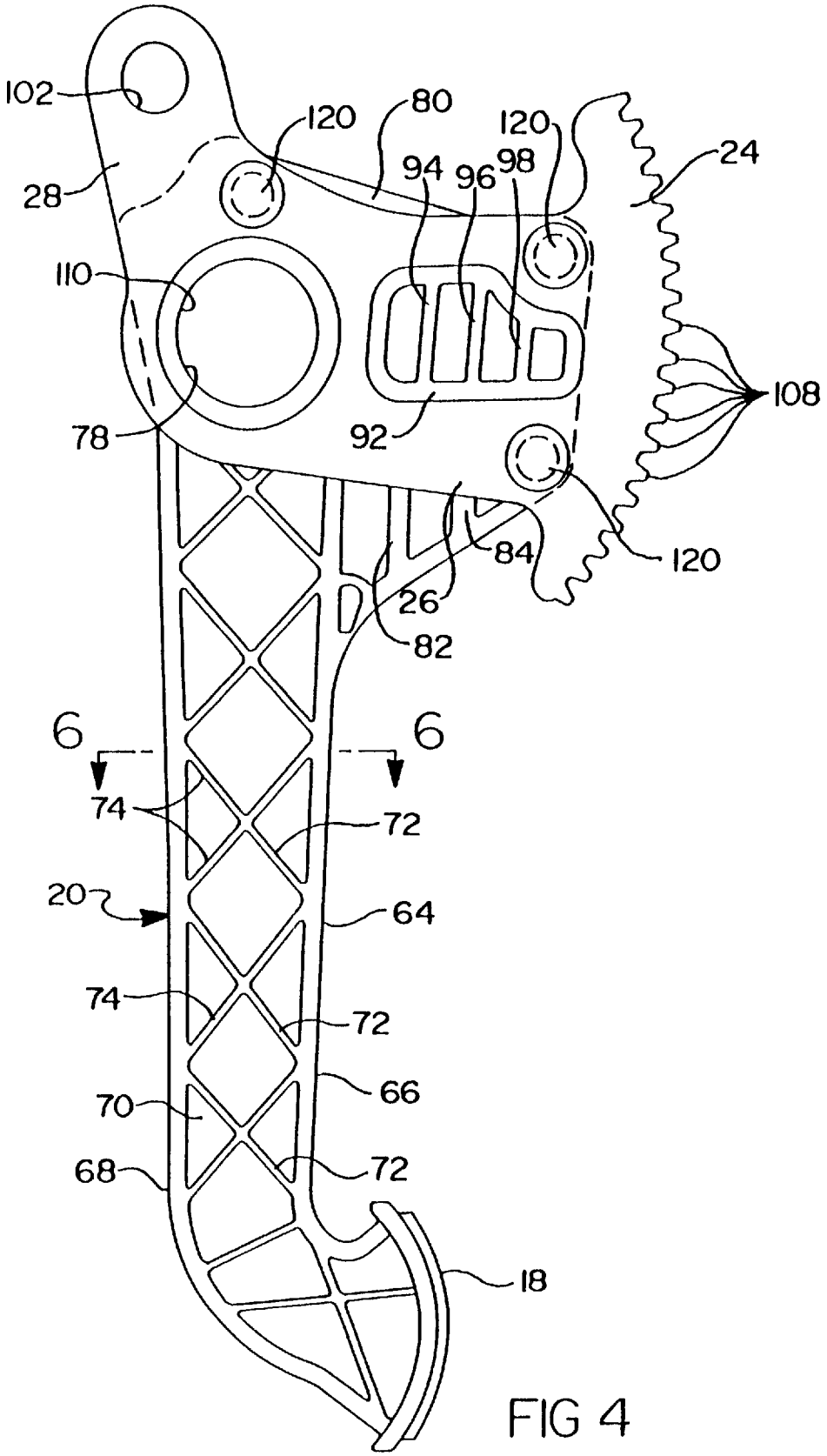
FIG. 4 is a side view of the operating lever with the metal insert attached.

A foot pad 18 is mounted on the outer end of an operating lever 20, which has its inner end pivotally received on a hollow pivot hub (not shown) formed on mounting bracket 12. As best seen in FIG. 4, an insert 26 has a sector gear segment 24 and is secured to lever 20 for rotation therewith, as will be later described. The end of the operating cable (not shown) is secured to a fitting 28 that is mounted on operating lever 20. Depressing of foot pad 18 rotates operating lever 20 counterclockwise, as viewed in FIG. 1, from the illustrated brake-released position to tension the operating cable as it applies the parking brake, as disclosed in the Swiatek patent.

Operating lever 20 is latched in any brake-applied position by a latch mechanism 32, which includes a pinion gear (not illustrated) having teeth which mesh with the teeth of sector gear segment 24, as is conventional. The pinion gear has an outer hub 38 mounted for rotation on a pivot pin 40. A torsion spring 42 has a fixed end secured to mounting bracket 12, and a free end (neither shown), as is conventional.

Torsion spring 42 surrounds and normally grips pinion hub 38 as a one-way clutch, self-expanding to permit counterclockwise rotation of the pinion, while contracting to engage pinion hub 38 to prevent clockwise rotation of the pinion. This permits operating lever 20 to be freely moved clockwise from the illustrated brake-release position of FIG. 1 to any brake-applied position where contraction of torsion clutch spring latches the operating lever in that position.

A vacuum operator 44, or, alternatively an electric device as disclosed in the Swiatek patent, is mounted on mounting bracket 12. Vacuum operator 44 can be energized to retract an output arm 52 which is pivotally attached to a release lever 60 which has a leg 62 for engaging the free end of torsion spring 42. When vacuum operator 44 is energized to retract arm 52, release leg 62 engages the spring free end to expand spring 42, which releases pinion hub 38, allowing a return spring 61 to return operating lever 20 to its brake release position.

The lower end 63 of release lever 60 mounts a manual release rod (not illustrated) that is connected to a manual lever (not illustrated) for manually operating lever 60, as disclosed in the Swiatek patent.

Referring now to FIGS. 2, 5, 6 and 7, operating lever 20 is a unitary molding made of a fiber-filled thermoplastic such as a polyester. 30%–45% glass fiber-filled nylon (one preferred form is 40% glass filled Nylon 3) has been found suitable. Operating lever 20 is molded as a single piece including integral foot pad 18. Operating lever 20 is a hollowed shell 64 formed as an open rectangle having sides 66 and 68 joined by a floor 70. An integral egg-crate reinforcing structure comprises crossed ribs 72, 74 interconnecting the sides 66, 68 and floor 70.

Operating lever 20 has an integral enlarged hub 76 defining an opening 78 for receiving the pivot hub 22. An integral flange 80 extends outwardly of hub 76, which has strengthening ribs 82, 84, 86, 88 and 90, and a raised drive lug 92 having strengthening ribs 94, 96 and 98. Drive lug 92 has an irregular pentagonal shape with rounded corners and one concave side. Integral mounting apertures 100 and 102 are molded into the outer corners of flange 80.

Referring additionally to FIG. 3, sector gear segment 24 of stamped steel insert 26 has teeth 108 which mesh with the teeth of the pinion gear. Insert 26 has a central aperture 110 which coincides with lever opening 78 and incorporates fitting 28 for receiving and retaining the end of the parking brake operating cable, as shown in the Swiatek patent. Insert 26 includes three mounting apertures 115, 116, 117 which match mating apertures 100, 102, 104 in operating lever 20. Insert 26 includes a drive aperture 118 which snugly receives lever drive lug 92, as shown in FIG. 5. This is the only driving connection between insert 26 and operating lever 20.

Rivets 120 are inserted through the mating aperture pairs 100 and 115, 102 and 116, and 104 and 117, as shown in FIG. 5 and are provided only to secure insert 26 to operating lever 20. The rivets do not transfer any cable tensioning forces to the operating lever. Force transfer to insert 26 is only via drive lug 92. This eliminates the need for precise tolerances and assembly of the rivets, thus reducing the cost of manufacture.

Another feature of this invention is the footpad 18 which is molded integrally with the operating lever 20. This enables elimination of the usual rubber footpad that is fitted over the end of the usual parking brake pedal. As shown in FIGS. 5 and 7, footpad 18 can be formed with an anti-skid design formed of alternating raised ridges and depressed grooves. Footpad 18 can be formed with this or any other non-skid design that can include logos or other decorative designs. operating lever 20 can be formed of any color to harmonize with any vehicle interior color. Alternatively, operating lever 20 can be molded of black plastic, which can be painted any color to harmonize with vehicle interior, with the footpad remaining black.

Operating lever 20 experiences the stress forces of parking brake application, as caused by stressing the cable, transferred through insert 26 by drive lug 92. However, when the operating lever is released and the parking brake is locked in applied position, all forces are borne by insert 26 alone, and operating lever 20 is isolated from the cable load path.

Parking brake actuators having prototype operating levers according to this invention have been tested in excess of 100,000 duty cycles without any failures. An alternative form of operating lever, designed for use in multiple pump cycle and other parking brake actuators which do not experience sustained stress loads, eliminates the steel insert, instead mounting only a half-moon-shaped steel sector. In this embodiment, not specifically illustrated here, the cable attachment is an integral part of the operating lever molding.

While only a preferred embodiment has been illustrated and described, obvious modifications thereof are contemplated within the scope of this invention.

We claim:

1. A parking brake actuator which comprises a mounting bracket, a pinion mounted on the mounting bracket, an operating lever pivotally mounted on the mounting bracket for movement between brake-released and a plurality of brake-applied positions, a metal insert mounted on the operating lever for attaching the end of a parking brake cable to the operating lever to transfer forces to the operating lever during brake apply movement of the operating lever, a metal sector gear mounted unitary with the metal insert for engagement with the pinion, thereby isolating the operating lever from cable forces in any brake-applied position, a one-way clutch normally permitting the pinion to rotate freely when the operating lever is moved to a brake-applied position, but preventing reverse rotation of the pinion to maintain the operating lever in any brake-applied position, and a clutch release operable to disable the one-way clutch and permit reverse rotation of the pinion to allow the operating lever to return to brake-released position, characterized by the operating lever being a unitary molding made of fiber-filled thermoplastic.

2. The parking brake actuator of claim 1, further characterized by the operating lever being formed with an integral footpad having a predetermined non-skid design.

3. The parking brake actuator of claim 1, further characterized by the operating lever having a raised drive lug and the metal insert having a mating drive aperture receiving the drive lug to transfer brake-apply forces from the operating lever to the sector gear.

4. The parking brake actuator of claim 3, further characterized by the drive lug and the drive aperture having an irregular pentagonal shape with rounded corners and one concave side.

5. The parking brake actuator of claim 3, further characterized by the operating lever including a raised hub, and by the metal insert including a central mating aperture which is fitted over the raised hub.

6. The parking brake actuator of claim 5, further characterized by the operating lever and the insert having mating spaced holes, and by the insert being attached to the operating lever by fasteners, which are received loosely in the holes such that all forces between the operating lever and the insert are transferred only by the drive lug.

7. The parking brake actuator of claim 5, further characterized by the operating lever and the insert each having a pair of mating spaced holes flanking the drive lug and the drive aperture, and by the insert being attached to the operating lever by rivets, which are received loosely in the holes such that all forces between the operating lever and the insert are transferred only by the drive lug.

8. A foot-operated parking brake actuator which comprises a mounting bracket, a pinion mounted on the mounting bracket, a pedal lever pivotally mounted on the mounting bracket for movement between brake-released and a plurality of brake-applied positions, attachment means attaching the end of a parking brake cable to the pedal lever to, a metal sector gear mounted on the pedal lever for engagement with the pinion, a one-way clutch normally permitting the pinion to rotate freely when the pedal lever is operated, but preventing reverse rotation of the pinion to maintain the lever in parking brake-applied position, and a clutch release operable to disable the one-way clutch and permit reverse rotation of the pinion to allow the pedal lever to return to released position, characterized by the pedal lever being a unitary molding made of 30%–45% glass fiber-filled nylon and by the pedal lever being molded in the form of a hollowed, three-sided shell having an internal egg-crate reinforcing structure and an integral footpad, and by the attachment means being a metal insert mounted on the pedal lever, the metal insert and the sector gear being a unitary piece of metal mounted on the pedal lever to transfer forces from the insert to the pedal lever during brake apply movement of the pedal lever and to isolate the pedal lever from forces in any brake-applied position.

* * * * *